US006207040B1

(12) United States Patent
Amadei

(10) Patent No.: US 6,207,040 B1
(45) Date of Patent: Mar. 27, 2001

(54) PROCESS FOR THE GASOLINES PRODUCTION

(76) Inventor: Roberto Amadei, Via G. Bruno 28/8, 16146 Genova (IT)

( * ) Notice: Subject to any disclaimer, the term of this patent is extended or adjusted under 35 U.S.C. 154(b) by 0 days.

(21) Appl. No.: 09/230,315

(22) PCT Filed: Jul. 21, 1997

(86) PCT No.: PCT/EP97/03920

§ 371 Date: Nov. 1, 1999

§ 102(e) Date: Nov. 1, 1999

(87) PCT Pub. No.: WO98/03613

PCT Pub. Date: Jan. 29, 1998

(30) Foreign Application Priority Data

Jul. 23, 1996 (IT) ..... RM96A0519

(51) Int. Cl.[7] ..... C10G 59/06
(52) U.S. Cl. ..... 208/79; 208/92; 208/134
(58) Field of Search ..... 208/64, 66, 65, 208/135, 134, 79, 92; 585/315

(56) References Cited

U.S. PATENT DOCUMENTS 4,457,832 * 7/1984 Robinson ..... 208/66

FOREIGN PATENT DOCUMENTS 0245 124 * 11/1987 (EP) ..... C10G/59/06
0 337 026 * 10/1989 (EP) ..... C10G/59/00
629 682 * 12/1994 (EP) ..... C10G/61/06

* cited by examiner

*Primary Examiner*—Bekir L. Yildirim

(57) ABSTRACT

The present invention refers to a process for the production of high-octane and low benzene content gasolines according to a cycle where a crude oil is fed into an atmospheric distillation unit from which a fraction is obtained called virgin naphtha seat in turn to a splitting unit that produces a fraction called light tops and a fraction called heavy naphtha wherein said heavy naphtha fraction has a six carbon atoms (C6) hydrocarbons content no greater than 0.5% volume, and said light tops fraction has a seven plus carbon atoms C7+) hydrocarbons content no greater than 4% volume. Said process allows in the refinery to contextually obtain quantitative and qualitative improvements in the gasolines production, with increase of the production yield and of the octane number as well as reduction of the produced benzene quantity.

4 Claims, No Drawings

PROCESS FOR THE GASOLINES PRODUCTION

FIELD OF THE INVENTION

The present invention refers to a process that allows in the refinery to contextually obtain quantitative and qualitative improvements in the gasoline production, with increase of the production yield and of the octane number as well as reduction of the produced benzene quantity.

BACKGROUND ART

A good resistance to self-ignition, expressed as high octane number, is necessary in the gasoline engines in order to obtain a good engine efficiency and therefore a higher fuel economy and a low pollution level.

Up to few years ago such goals were, and partly still today are, reached by adding an antiknock to the gasoline, essentially tetraethyl- and/or tetramethyl-lead. Nevertheless the traditional engines exhaust gases contain highly harmful substances, such as carbon monoxide, hydrocarbons, nitrogen oxides, sulphur oxides and lead, the latter being dangerous because of the effects that it may have on the central nervous system and because of the strong carcinogenic potential of further added substances (called "scavengers"), necessary to remove lead from the engine chamber deposits and transformed into dioxins during the combustion. Therefore it has been decided, starting from the United States of America, to abate the pollutants by promoting their conversion into harmless, or at least much less dangerous gases, by means of catalytic converters set on the engine exhaust outlet, reducing in this way the emitted quantity of them. The lead, however, rapidly inactivates the converter catalyst, and also for this reason, besides to avoid the above recalled health hazards, the decision had to be taken to remove it from the gasolines. To obtain this, it has been agreed to start the exclusive commercialization of vehicles equipped with catalytic converter, and hence, parallelly, to commercialize unleaded gasolines, and to progressively reduce the production and the sales of leaded gasolines, as well as the gasoline lead content, in parallel with the reduction of the circulating cars that use them. But in order to maintain the engines efficiency it is necessary to keep a high octane number, which was obtained by increasing the benzene and other aromatic compounds content. The benzene is a highly toxic compound, the most toxic molecule of gasoline, and it is recognized as one of the most powerful carcinogenic agents. With the increase of the gasoline benzene content the benzene emissions to the air rapidly increase, both from evaporation due to its high volatility, and from after-combustion combustion. For these reasons its concentration in the gasolines results by far the most critical parameter from the health hazard point of view.

The content of benzene and of the other aromatics in the unleaded gasolines was, at the beginning of their commercialization, respectively 5% and 60% maximum. Subsequently, the different national legislations considered abatements of this component; in the USA, the only country in the world prescribing such a low limit, starting from 1.1.95 the benzene content is fixed at 1% volume maximum, for the reformulated gasolines, whose market share is about 25%.

In the European Union, starting from October the 1st, 1989, the allowed level is at maximum 5% volume, with a forecast of gradually lowering it in the future. In Italy, since the beginning of 1993, the law prescribed a benzene content not higher than 3%, meant as the quarterly weighted average of the sales coming from each refinery. Recently, as a spontaneous initiative, a national company put on sale on the whole national territory unleaded gasoline with a lower than 1% benzene content.

Generally speaking, a petroleum refinery, producing several products among which gasoline, comprises an atmospheric distillation unit that is fed by the crude oil and produces a light fraction composed by gas and LPG, an intermediate fraction called "virgin naphtha" and heavier fractions. The virgin naphtha feeds a splitting unit, giving rise to a fraction, called "light tops", essentially composed of five carbon atoms hydrocarbons (C5) (and in certain units also of the lower-boiling part of the six carbon atoms molecules), and to a heavy fraction, called heavy naphtha, containing the C6 molecules (or in the above units the higher-boiling part of C6) and other molecules, up to C11. The cutting temperature is 65–70° C. The light tops are usually fed to an isomerization processing unit, that produces gas and LPG, as light fraction, and isomerization gasoline, or isomerate, to be sent to the finished gasoline blending.

The heavy naphtha is fed to a catalytic reforming processing unit, from which gas and LPG again are obtained from one side and reforming gasolines, to be sent to the finished gasoline blending, from the other side.

It is just the C6 higher-boiling fraction, containing the benzene precursors, that in the reformer produces a considerable amount of benzene and consequently a noteworthy pollution from evaporation, already in the refinery.

Therefore the production of benzene is a physiological fact of the oil refining, but till now it has not been considered economically possible to limit it.

In Oil & Gas Journal, April the 27th, 1987, page 74, a meeting among representatives of the big worldwide oil companies is reported, in which a crucial point has been the way to abate in the refinery the benzene content; among the discussed methods the simplest one is to extract the benzene produced in the reformer. This method adds up an operation, with the relevant investment and operating costs, to the production process, keeps the problem of benzene pollution around the refinery and presents on top of that the one of the cumulated benzene disposal.

Other methods have been reminded, among which in particular the shifting of the reformer feed cutting point towards higher initial boiling temperatures, that is towards the exclusion of at least a fraction of the high-boiling C6. It is anyway affirmed that this method is antieconomic.

It is also clearly said that the removal of the benzene precursors from the reformer feed doesn't eliminate the problem, because there are also other benzene sources, such as the dealkylation of higher carbons number aromatics. The same problem is faced up by the CONCAWE (defined "the oil companies' european organization for environmental and health protection") in a publication entitled "Economic consequences of limiting benzene/aromatics in gasoline". The Hague, July 1989, page 10. Here in particular it is asserted that the most effective method to reduce the reformate benzene would be to increase the initial boiling point of the reformer feed, but this method would carry some problems, particularly the lower reformer throughput, the fact of having a heavier feedstock with operating problems and the decrease of the product octane number. The solution for this last drawback could be that of dividing the "straight run" gasoline into a fraction, C5+light C6, to be isomerized, and in a heavier fraction to be directly sent to the gasoline blending. This method is considered expensive. For the benzene reduction costs minimization this publication indicates in an unequivocal way a cutting temperature of 66° C., implying to send all the benzene precursors to the catalytic reformer.

In the summary of this publication it is declared that "Further reduction of benzene below 3% vol would need installation of additional isomerization and benzene extraction facilities also in complex refineries". A benzene limit at 1% volume would require an investment of 1750 millions dollars for the European Community refineries. The manufacturing cost would increase by 16–20 dollars per ton for the simple refineries and by 8–12 dollars per ton for the complex refineries. And, moreover, at the 3.1.3 paragraph, it is admitted that the benzene target of 1% volume can be reached only by extracting it from the reformate, and this for all the examined process schemes.

In a more recent CONCAWE publication ("Catalogue of CONCAWE special interest reports", Brussels, January 1996, page 31) it is still reminded that decrease of the benzene level in the unleaded gasolines beneath 1% would require a global investment of around 1750 million dollars only in Europe, would considerably increase the costs of production and in any case it would let the problem of eliminating two millions tons per year of extracted benzene unsolved. Similar concepts to the previously expressed ones can be found at page 23 of the report "Gasoline processing for the 1990's" of the UOP 1990 Fuels Technology Conference, held in Montecarlo. Here as well the method of removing the benzene precursors from the reformer feed and of charging them to the isomerization is considered interesting but little feasible, because of the increased hydrogen consumption for the saturation of benzene and of its precursors, of the difficulty to remove a sufficient quantity of precursors in certain types of feedstocks, of the benzene production by superior aromatics dealkylation in the reformer and overall because of the octane loss that would be implied by charging the precursors containing stream itself to the isomerization instead than to the catalytic reformer.

Similar conclusions to the above mentioned ones are contained as well in "Dossier Benzene",—published March the 20th, 1995 by the Unione Petrolifera, an organization gathering all the Italian oil companies. In this report all the possible refinery interventions are listed, that is:

the reduction/elimination of the precursors;

the reduction of the reformer severity;

the extraction and the treatment of benzene.

The first alternative would assume, according to the report, the possibility of the crude oils selection (limiting the operating flexibility and hence antieconomonic) and the change of the feed distillation range; in this respect the light tops cutting point increase to 95° C. would allow to remove almost all the benzene precursors but it would generate a series of collateral problems, such as the throughput reduction and the unoptimization of the catalytic reforming process, and the increase of the straight-run fraction share in the gasolines pool.

Other methods examined in the report "that do not act directly on the benzene or on its precursors are in connection with the blending in the gasolines pool of components coming from isomerization and alkylation units", that, as the report follows, allows a reformer severity reduction and a dilution of the benzene containing fraction; however these methods have little effectiveness in order to solve the problem in consideration of the obvious limitations of the possible use of these components.

However in any case the problem remains of reaching a satisfactory octane number, for instance by additional bending of antiknocks, such as the MTBE (methyl-ter-butyl-ether), or by increasing the reformer operating severity lowering the yield, both expensive solutions.

It is evident that, so far, the solutions considered feasible of the gasolines benzene content limitation problem, particularly beneath 1% volume, are all expensive and not lacking additional complex problems, such as the use of a benzene production surplus correspond to about 40% of the present market, already practically saturated (See Concawe and U.P. reports).

BRIEF DESCRIPTION OF THE INVENTION

It is a purpose of the present invention the abatement of benzene content in all gasolines, whether leaded or unleaded, (i.e. a 70% average reduction of this content) and consequently of the relevant emissions, both evaporative and exhausted (from the engines tailpipe).

Another purpose of the present invention is the increase of high-octane gasolines production yields and capacity, to be used also in uncatalyzed engines in replacement of the leaded gasolines with an evident further reduction of health hazards resulting from the gasolines use.

According to the invention it is possible to remove the lead from a share of the whole gasolines production (leaded plus unleaded gasoline) that can reach 50%, holding the same octane rates of the present leaded gasoline, or, alternatively, to remove the lead and to increase both ROM and MON octane numbers by one point over relevant values of present leaded gasoline for a whole production share that can reach 33%.

A further purpose of the invention is the replacement of expensive high-octane blenders, supplied from outside the refinery, and/or of octanizing processing units investments.

It is another purpose of this invention the straight production in the refinery, and without additional processing steps, of gasolines, both leaded and unleaded, with a lower than 1% volume benzene content.

Yet a further purpose of the present invention is to obtain a production yields improvement.

All the above is possible by sending all the C6 in charge to the isomerization unit, where said C6 don't give rise to benzene formation, and where also the natural benzene content of the crude oil (which is on the average around 0.1–0.2% wt) is transformed into atoxic compounds.

The above said purposes of the invention, as well as other ones that should get evident and/or that could be derived from the following description, and the characteristics of the invention itself will be made more evident by the following detailed description.

DETAILED DESCRIPTION OF THE INVENTION

According to the present invention, an accurate use of the virgin naphtha splitting column allows to produce in a simple and economic way high-octane gasolines. In fact, contrary to what has been till now considered by the up-to-date technology, it is possible and useful charging to the isomerization unit all the C6 hydrocarbons, obviously within the even sharp distillation feasibility limits.

This is possible operating, in the splitting unit, in such a way as to obtain a specific separation of the flows compositions, that's to say in order to have in the fraction to be charged to the reformer a C6 maximum content of 0.5% volume, preferably lower than 0.3% volume, while in the fraction to be charged to the isomerization the maximum C7 plus content must be 4% volume, preferably lower than 2%. The corresponding cutting temperature (true boiling end point of the light tops) results as being comprised, variation being function of crude oil type, between 85 and 95° C. The initial boiling point (ASTM IBP) of the heavy naphtha, being the reformer feed, results as being comprises between 92° and 102° C.

The results that can be obtained by applying the present invention can be summarized as described below.

The virgin naphtha differential fraction (in comparison with the traditional technology) to be added to the isomerization feed and to be subtracted from the catalytic reformer feed, hereabove called higher-boiling C6, gets in this way better yields to the refinery, exactly the opposite of what is assumed in the up-to-date technology; moreover it gets, as we will see below, the possibility of increasing the refinery total production. Obviously such results carry considerable economic advantages.

By analyzing such better yields, the following causes and effects can be pointed out.

better performance of the higher-boiling C6 marginal stream; it consists in a higher weight yield of the gasoline production (about 90 vs. about 70%) and in a higher Motor Octane Number -MON- (about 80 vs. about 70). The Research Octane Number -RON- is approximately equal in the two methods (about 83). It must be remarked that the yield increase results still more important when considering the volumes instead than the weights.

Moroever the MON is the critical octane number, such that, once reached its specification limit, also the RON limit results automatically satisfied.

better performance of the catalytic reformer feed, consisting in a strong increase, of about 3 points, in the octane number (both ROM and MON), the average catalytic bed temperature being equal, or alternatively, in a two percentage points increase, about, of the product yield, the octane number being equal and the average catalytic bed temperature being lower.

in the catalytic reformer a production capacity becomes available corresponding to the feedstock portion (the higher-boiling C6) shifted to the isomerization (about 10% average of the virgin naphtha), that allows to increase the gasoline production. Such production increase is realized in a quantity more than corresponding to the reforming capacity made available, thanks to the reformate octane positive margin over the finished gasoline specification.

Furthermore the reformer is the process unit that produces the highest octane number gasoline component, and that can adjust its operating conditions to obtain a product with such an octane number that the finished gasolines blends just meet the required specification limits; by operating according to the invention the capacity of this unit, which become insufficient because of the lead phrase-down and of the great gasoline demand increase of the last years, is compensated. Since the petroleum refining is the typical joined products industry, above mentioned compensation is equivalent, to the refinery, to the remotion, or better to the relaxation, of a quantitative limitation of the total crude oil processing capacity and allows to obtain an added value given by the processed crude additional quantity.

Moreover, according to the invention, the reformate benzene content is about 1–1.5% volume, while the isomerate one is zero.

Finally, the invention allows to realize, as it is quite obvious for the expert, a few other improvements of the gasoline performative and environmental quality among which we mention a significant reduction of the gasolines pool total aromatics content and of the relevant sulphur and olefins contents.

In conclusion, it is evident that, operating according to the present invention, the result is obtained of reducing (by about 90%) the benzene production in the refinery and of getting higher high-octane gasolines yield, directly from the reforming and isomerization units, possibly downstream of blending with other kinds of components, either produced or bought by the refinery.

EXAMPLE 140 tons per hour of a C5-170° C. desulphurated stabilized SR naphtha ex Zueitina crude are fed to a splitting column having 70 trays.

The column is operated with a reflux ration of 2.2, a reboiler duty of $10.7\times10^6$ kcal/hour and a condenser duty of $9.5\times10^6$ kcal/hour.

Given the feed composition and flow-rate as illustrated in Table 1, the obtained results in terms of tops (isomerization feed) and bottom (reforming feed) compositions and flow-rates are exposed as well in Table 1.

TABLE 1

| Molecules/ | Splitter feed composition | Tops composition | | Bottom composition | |
|---|---|---|---|---|---|
| molecules families | wt. pct. | wt. pct. | vol. pct. | wt. pct. | vol. pct. |
| normal butane | 0.10 | 0.48 | | | |
| isopentane | 3.04 | 14.49 | | | |
| normal pentane | 3.47 | 16.54 | | | |
| cyclopentane | 0.35 | 1.67 | | | |
| C6 isoparaffins | 4.88 | 23.26 | | | |
| normal hexane | 4.81 | 22.79 | | 0.04 | |
| C6 naphthenes | 3.60 | 16.27 | | 0.23 | |
| benzene | 0.48 | 2.15 | | 0.04 | |
| C7 isoparaffins | 7.02 | 1.81 | | 8.40 | |
| C7 naphthenes | 5.99 | 0.51 | | 7.44 | |
| normal heptane | 5.68 | 0.03 | | 7.18 | |
| C8 isoparaffins | 6.78 | | | 8.57 | |
| C8 naphthenes | 8.87 | | | 11.24 | |
| toluene | 0.65 | | | 0.83 | |
| normal octane | 5.89 | | | 7.45 | |
| C8 aromatics | 2.68 | | | 3.39 | |
| C9+ | 35.71 | | | 45.19 | |
| Total | 100.00 | 100.00 | | 100.00 | |
| of which | | | | | |
| Total tops C7+ | | 2.35 | 2.3 | | |
| Total bottom C6 | | | | 0.31 | 0.3 |
| Flow-rate, t/hour | 140 | 29.4 | 110.6 | | |

What is claimed is:

1. High yield process for the production of high-octane and low benzene content gasolines according to a cycle where a crude oil is fed into an atmospheric distillation unit from which a fraction is obtained called virgin naphtha sent in turn to a splitting unit that produces a fraction called light tops and a fraction called heavy naphtha, respectively sent to a processing unit called isomerization and to a processing unit called catalytic reformer, characterized in that the heavy naphtha fraction has a six carbon atoms (C6) hydrocarbons content no greater than 0.5% volume, and the light tops fraction has a seven plus carbon atoms (C7+) hydrocarbons content no greater than 4% volume.

2. Process according to claim 1, characterized in that the heavy naphtha C6 content must be no greater than 0.3% volume.

3. Process according to any one of the preceding claims, characterized in that the light tops C7+ content must be no greater than 2% volume.

4. Processing according to claim 1, characterized in that said composition limitation of the light tops and heavy naphtha fractions is obtained by choosing in the splitting unit such a cutting temperature that the initial boiling temperature (ASTM IBP) of the heavy naphtha fed into the reformer results comprised between 92 and 102° C.

* * * * *